US009152106B2

(12) United States Patent
Yamaguchi et al.

(10) Patent No.: US 9,152,106 B2
(45) Date of Patent: Oct. 6, 2015

(54) FIXING DEVICE AND IMAGE FORMING APPARATUS INCLUDING SAME

(71) Applicants: Yoshiki Yamaguchi, Kanagawa (JP); Takayuki Seki, Kanagawa (JP); Yuji Arai, Kanagawa (JP); Yutaka Ikebuchi, Kanagawa (JP); Shuntaroh Tamaki, Kanagawa (JP); Kazuya Saito, Kanagawa (JP); Kenji Ishii, Kanagawa (JP); Tadashi Ogawa, Tokyo (JP); Teppei Kawata, Kanagawa (JP); Toshihiko Shimokawa, Kanagawa (JP); Arinobu Yoshiura, Kanagawa (JP); Kensuke Yamaji, Kanagawa (JP); Hiromasa Takagi, Tokyo (JP); Naoki Iwaya, Tokyo (JP); Takahiro Imada, Kanagawa (JP); Akira Suzuki, Tokyo (JP)

(72) Inventors: Yoshiki Yamaguchi, Kanagawa (JP); Takayuki Seki, Kanagawa (JP); Yuji Arai, Kanagawa (JP); Yutaka Ikebuchi, Kanagawa (JP); Shuntaroh Tamaki, Kanagawa (JP); Kazuya Saito, Kanagawa (JP); Kenji Ishii, Kanagawa (JP); Tadashi Ogawa, Tokyo (JP); Teppei Kawata, Kanagawa (JP); Toshihiko Shimokawa, Kanagawa (JP); Arinobu Yoshiura, Kanagawa (JP); Kensuke Yamaji, Kanagawa (JP); Hiromasa Takagi, Tokyo (JP); Naoki Iwaya, Tokyo (JP); Takahiro Imada, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/013,206

(22) Filed: Aug. 29, 2013

(65) Prior Publication Data

US 2014/0064804 A1 Mar. 6, 2014

(30) Foreign Application Priority Data

Aug. 31, 2012 (JP) ..... 2012-191641
Oct. 31, 2012 (JP) ..... 2012-241031

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053; G03G 2215/2035
USPC ..... 399/122, 320, 328, 329, 331, 400
See application file for complete search history.

(56) References Cited

U.S. PATENT DOCUMENTS 6,055,390 A 4/2000 Kurotaka et al.
7,917,074 B2 * 3/2011 Takada ..... 399/329

(Continued)

FOREIGN PATENT DOCUMENTS

JP 4-044075 2/1992
JP 8-262903 10/1996

(Continued)

*Primary Examiner* — Francis Gray
(74) *Attorney, Agent, or Firm* — Oblon, McCelland, Maier & Neustadt, L.L.P.

(57) ABSTRACT

A fixing device includes a rotary fixing member, a heater, a pressing member, a nip formation member, a reinforcement member, a sliding sheet, and a holding member. The nip formation member is disposed at an inner circumferential side of the fixing member and pressed by the pressing member via the fixing member to form a nipping portion. The reinforcement member is stationarily disposed in an internal diameter area of the fixing member to support the nip formation member. The sliding sheet is disposed between the nip formation member and an inner circumferential face of the fixing member. The holding member is disposed at a member differing from the nip formation member to hold the sliding sheet in a state in which the sliding sheet is in close contact with a nipping face of the nip formation member facing the nipping portion.

16 Claims, 6 Drawing Sheets

(56) References Cited

U.S. PATENT DOCUMENTS

| | | | | |
|---|---|---|---|---|
| 2007/0292175 | A1 | 12/2007 | Shinshi | |
| 2010/0067929 | A1 | 3/2010 | Seki | |
| 2010/0092220 | A1 | 4/2010 | Hasegawa et al. | |
| 2010/0196065 | A1* | 8/2010 | Matsuki et al. | 399/329 |
| 2010/0290822 | A1 | 11/2010 | Hasegawa et al. | |
| 2011/0076071 | A1 | 3/2011 | Yamaguchi et al. | |
| 2011/0116848 | A1 | 5/2011 | Yamaguchi et al. | |
| 2011/0188907 | A1 | 8/2011 | Seki | |
| 2012/0121305 | A1 | 5/2012 | Yoshikawa et al. | |
| 2012/0148303 | A1* | 6/2012 | Yamaguchi et al. | 399/122 |
| 2012/0155936 | A1 | 6/2012 | Yamaguchi et al. | |
| 2012/0275834 | A1* | 11/2012 | Naitoh et al. | 399/329 |
| 2013/0170880 | A1 | 7/2013 | Gotoh et al. | |
| 2013/0183070 | A1 | 7/2013 | Kawata et al. | |
| 2013/0189008 | A1 | 7/2013 | Ishii et al. | |
| 2013/0195524 | A1 | 8/2013 | Ishii et al. | |
| 2013/0236223 | A1* | 9/2013 | Matsumoto et al. | 399/329 |
| 2013/0251390 | A1* | 9/2013 | Ishii et al. | 399/67 |

FOREIGN PATENT DOCUMENTS

| | | | |
|---|---|---|---|
| JP | 10-213984 | | 8/1998 |
| JP | 11-002982 | | 1/1999 |
| JP | 2007-334205 | | 12/2007 |
| JP | 2008070747 | A * | 3/2008 |
| JP | 2010-096782 | | 4/2010 |
| JP | 2010-286815 | | 12/2010 |
| JP | 2011-070070 | | 4/2011 |

* cited by examiner

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2012-191641, filed on Aug. 31, 2012, and 2012-241031, filed on Oct. 31, 2012, in the Japan Patent Office, the entire disclosure of each of which is hereby incorporated by reference herein.

BACKGROUND

1. Technical Field

This disclosure relates to a fixing device and an image forming apparatus including the fixing device, and more specifically to a fixing device to fix a toner image on a recording medium by heat and pressure and an image forming apparatus, such as a facsimile machine, a printer, a copier, or a multi-functional device having at least one of the foregoing capabilities, which includes the fixing device and employs, e.g., an electrophotographic or electrostatic recording method.

2. Description of the Related Art

Image forming apparatuses are used as printers, facsimile machines, copiers, plotters, or multi-functional devices having, e.g., two or more of the foregoing capabilities. As one type of image forming apparatuses, electrophotographic image forming apparatuses are known. For example, an electrophotographic image forming apparatus forms an electrostatic latent image on a surface of a photoconductor drum serving as an image bearer, develops the latent image on the photoconductor drum with, e.g., toner serving as developing agent to form a visible image, transfers the toner image onto a recording sheet (also referred to as recording medium or sheet of paper) by a transfer device, and fixes the toner image on the recording sheet by a fixing device.

Such a fixing device may have a fixing member and a pressing member, which are formed with, e.g., an opposing roller(s), a belt(s), and/or a combination thereof. The pressing member is configured to contact the fixing member to form a nipping portion between the pressing member and the fixing member. The fixing member and the pressing member sandwich a recording sheet at the nipping portion, and heat and pressure are applied to fix a toner image on the recording sheet.

For example, a technique is known using a fixing belt extending between roller members as a fixing member (e.g., see JP-H11-002982-A). As illustrated in FIG. 1, the fixing device includes, for example, a fixing belt (endless belt) 204 serving as a fixing member, multiple roller members 202 and 203, a heater 201, and a pressing roller (pressing member) 205. The roller members 202 and 203 support the fixing belt 204, and the fixing belt 204 is wound around the roller members 202 and 203. The heater 201 is disposed inside one (the roller member 202) of the roller members 202 and 203. The heater 201 heats the fixing belt 204 via the roller member 202. When a recording medium P is fed toward a fixing nip portion (nipping portion) N between the fixing belt 204 and the pressure roller 205, heat and pressure are applied to a toner image on the recording medium P to fix the toner image on the recording medium P (belt fixing method).

Some fixing devices have a stationary member to slidingly contact an inner surface of a fixing member serving as a rotary body. For example, JP-H04-044075 proposes a fixing device using a film heating method. As illustrated in FIG. 2, such a fixing device includes, e.g., a ceramic heater 211, a pressing roller 212, and a heatproof film (fixing film) 213. The ceramic heater 211 serves as a heat generator and the pressing roller 212 serves as a pressing member. The ceramic heater 211 and the pressing roller 212 sandwich the film 213 and form a fixing nip portion (nipping portion) N. A recording medium bearing a toner image to be fixed is introduced between the film 213 and the pressing roller 212 in the nipping portion N, and conveyed with the recording medium P sandwiched together the film 213. Heat of the ceramic heater 211 is applied to the recording medium at the nipping portion N via the film 213. Additionally, pressing force is applied to the recording medium at the nipping portion N to fix the toner image on the recording medium.

Such a fixing device using the film heating method can be an on-demand type of fixing device using a small heat capacity of members as the ceramic heater and the heatproof film. Only when an image forming apparatus including the fixing device performs image formation, the ceramic heater serving as heat source is electrified to generate heat to a desired fixing temperature. Such a fixing device is advantageous in a relatively short waiting time (quick start) from when the image forming apparatus is powered on to when the image forming apparatus turns into an executable state for image formation, a relatively small power consumption in the standby state (power saving), and so on.

Alternatively, for example, JP-H08-262903-A and JP-H10-213984-A propose image fixing devices using pressure belt methods. Such a fixing device may have a heat fixing roll, an endless belt, and a pressing pad. The heat fixing roll is rotatable and has an elastically deformable surface. The endless belt (pressing belt) is movable while contacting the heat fixing roll. The pressing pad is disposed in non-rotational state inside a loop of the endless belt to press the endless belt against the heat fixing roll to form a belt nip between the endless belt and the heat fixing roll. A recording sheet is passed through the belt nip. The pressing pad elastically deforms the surface of the heat fixing roll. For such a fixing method, a belt is used as a lower pressing member to increase a contact area between a recording sheet and a roll. Such a configuration enhances the efficiency of heat conduction, suppresses energy consumption, and allows downsizing.

For example, the above-described fixing device like that described JP-H11-002982-A is advantageous in speedup over a fixing device using a fixing roller. However, the fixing device are disadvantageous in reducing a warm-up time (a time required to reach a printable temperature) or a first print time (a time required to, after reception of a print request, prepare printing, perform print operation, and output a printed sheet).

By contrast, the fixing device described JP-H04-044075 has a relatively small heat capacity, thus allowing downsizing and a reduction in the warm-up time and/or the first print time. However, the fixing device described JP-H04-044075 is disadvantageous in durability and temperature stability of the belt.

In other words, the fixing device described JP-H04-044075 may be insufficient in wearing resistance to the sliding of the fixing belt over the ceramic heater. When the fixing device is driven for a long time, friction against the fixing belt is continuously repeated, thus causing a rough surface of the fixing belt. As a result, friction resistance is increased, thus resulting in unstable running of the belt or an increase in driving torque of the fixing device. Consequently, a transfer sheet on which an image is formed may slip on the fixing belt, thus causing displacement of the image. Additionally, stress to a driving gear may increase, thus giving damage to the driving gear.

In addition, for the fixing device using the film heating method, since the belt is intensively heated at the nipping portion, the temperature of the belt becomes lowest when the belt in rotation returns to an entry to the nipping portion. As a result, in particularly, when the belt is rotated at high speed, a fixing failure may occur.

By contrast, for JP-H08-262903-A, an outer surface of the pressing pad includes a polytetrafluoroethylene (PTFE) impregnated glass-fiber sheet (PTFE-impregnated glass cloth) as a low friction sheet (sheet-type sliding member) to improve the sliding performance of the inner circumferential surface of the belt and the stationary member. However, for such pressure-belt type fixing devices (described in JP-H08-262903-A and JP-H10-213984-A), the fixing roller may have a relatively large heat capacity, thus increasing the warm-up time.

In light of the above-described challenges, for example, JP-2007-334205-A proposes a fixing device including an endless fixing member, an opposed member and a resistant heat generator. The opposed member (metal heat conductor or support member) has a substantially tubular shape and is disposed at an inner circumferential side of the endless fixing member. The resistant heat generator is, e.g., a ceramic heater disposed at an inner circumferential side of the opposing member to heat the opposing member. Such a configuration allows heating of the entire fixing belt and a reduction in the warm-up time and the first print time, and prevents deficiency of the heat amount during high speed rotation.

However, for the fixing device described in JP-2007-334205-A, a pressing roller serving as a pressing member is pressed toward the fixing belt to form a nipping portion, and the nipping portion is supported by the metal heat conductor. Such a configuration may be unstable in the width and pressure of the nipping portion N.

Hence, to stably retain a state, a shape, and/or a position of the nipping portion formed by the fixing belt and the pressure roller or a tubular heating member, for example, JP-2010-096782-A proposes a configuration in which, e.g., a nip formation member (contact member or stationary member) and a reinforcement member are disposed corresponding to the position of the nipping portion.

The pressure roller is pressed against the nip formation member via the fixing belt, and the nip formation member slidably contacts the fixing belt rotated in a circumferential direction. Therefore, a surface of the nip formation member preferably has a low friction relative to the fixing belt. Additionally, to obtain a high quality image, the nip formation member preferably has a relatively high elasticity like rubber to follow minute irregularities of a surface of the recording medium. However, since rubber typically has a high friction relative to the fixing belt, it may be difficult to use rubber as a material of the surface of the nip formation member.

Hence, by mounting a sliding sheet (low friction sheet) on the surface of the nip formation member, both high elasticity like rubber and low friction can be obtained. However, because of rotation of the fixing belt, the sliding sheet continuously receives shearing stress at a downstream side in a rotation direction of the fixing belt. Therefore, the sliding sheet is preferably firmly fixed on a face of the nip formation member facing the nipping portion.

For example, as a technique of fixing the sliding sheet to the nip formation member, the sliding sheet is wound around the nip formation member and screw holes are formed in an opposite face of the nip formation member opposite the nipping portion to fasten the sliding sheet with screws. Alternatively, JP-2011-070070-A proposes a method in which a nip formation member has an engaging structure including a projecting portion and a recessed portion to sandwich and fix the sliding sheet between the projecting portion and the recessed portion. However, such configurations of the above-described technique and JP-2011-070070-A increase the number of components of the nip formation member, thus increasing the production cost.

BRIEF SUMMARY

In at least one exemplary embodiment of this disclosure, there is provided a fixing device including a rotary fixing member, a heater, a pressing member, a nip formation member, a reinforcement member, a sliding sheet, and a holding member. The rotary fixing member has an endless shape. The heater heats the rotary fixing member. The pressing member is disposed at an outer circumferential side of the rotary fixing member to press against the rotary fixing member. The nip formation member is disposed at an inner circumferential side of the rotary fixing member and configured to be pressed by the pressing member via the rotary fixing member to form a nipping portion. The reinforcement member is stationarily disposed in an internal diameter area of the rotary fixing member to support the nip formation member from a first side of the nip formation member opposite a second side of the nip formation member at which the nip formation member faces the nipping portion. The sliding sheet is disposed between the nip formation member and an inner circumferential face of the rotary fixing member. The holding member is disposed at a member differing from the nip formation member to hold the sliding sheet in a state in which the sliding sheet is in close contact with a nipping face of the nip formation member facing the nipping portion.

In at least one exemplary embodiment of this disclosure, there is provided an image forming apparatus including the above-described fixing device.

In at least one exemplary embodiment of this disclosure, there is provided a fixing device including a fixing member, a base member, a sliding sheet, an opposed member, a support member, and a metal body. The fixing member has an endless shape. The base member is disposed at an inner circumferential side of the fixing member. The base member contacts an inner circumferential surface of the fixing member via the sliding sheet. The opposed member is configured to contact an outer circumferential surface of the fixing member at a position opposing the base member. The support member supports the base member. The base member is fixed relative to the support member via the metal body. The sliding sheet is fixed on the metal body.

In at least one exemplary embodiment of this disclosure, there is provided an image forming apparatus including the above-described fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
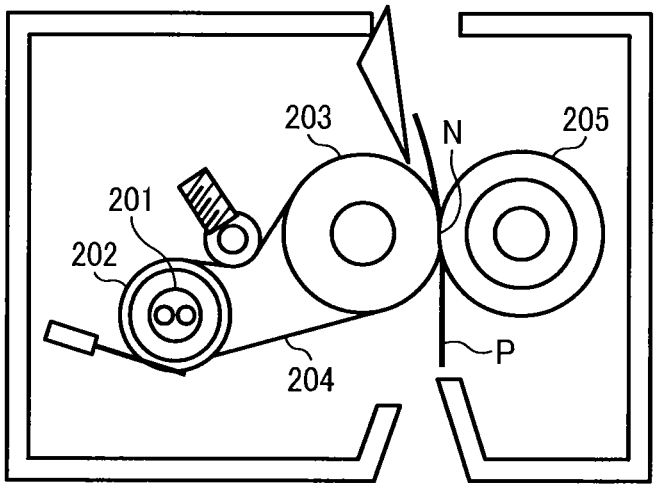
FIG. 1 RELATED ART
FIG. 1 is a schematic configuration view of a fixing device of a conventional belt fixing type.
Figure 2:
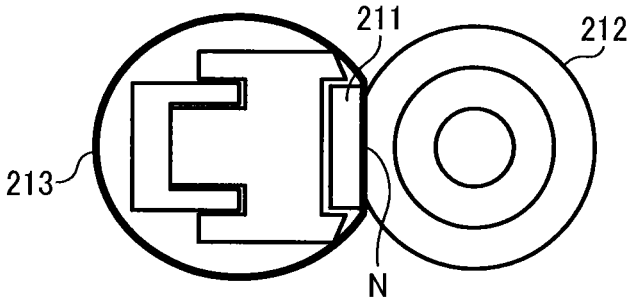
FIG. 2 RELATED ART
FIG. 2 is a schematic configuration view of a fixing device of a conventional film heating type.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to at least one exemplary embodiment of this disclosure is described with reference to FIGS. 3 to 5.

Figure 3:
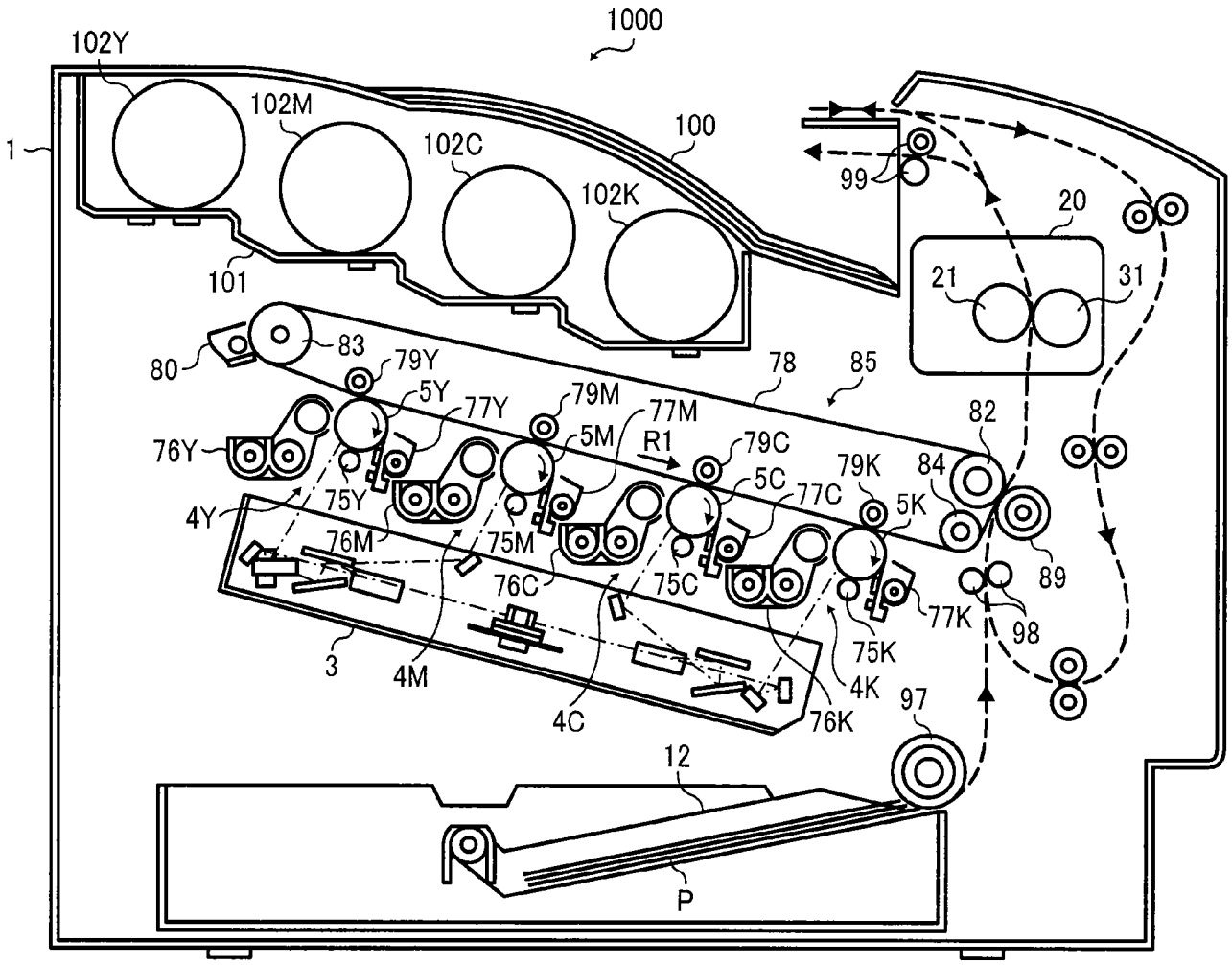
FIG. 3 is a cross sectional view of an image forming apparatus according to an exemplary embodiment of this disclosure.

FIG. 3 is a schematic view of an entire configuration of an image forming apparatus 1000 according to an exemplary embodiment of this disclosure. In FIG. 3, the image forming apparatus 1000 is illustrated as a tandem color printer. However, it is to be noted that the image forming apparatus is not limited to the tandem color printer and may be any other suitable type of image forming apparatus. An internal configuration of the image forming apparatus 1000 is described below with reference to FIG. 3.

A toner bottle holder 101 is provided in an upper portion of an apparatus body 1 of the image forming apparatus 1000. Four toner bottles 102Y, 102M, 102C, and 102K contain yellow, magenta, cyan, and black toners, respectively, and are detachably (replaceably) attached to the toner bottle holder 101.

An intermediate transfer unit 85 is provided below the toner bottle holder 101. Image forming devices 4Y, 4M, 4C, and 4K corresponding to yellow, magenta, cyan, and black, respectively, are arranged opposing an intermediate transfer belt 78 of an intermediate transfer unit 85.

The image forming devices 4Y, 4M, 4C, and 4K include photoconductor drums 5Y, 5M, 5C, and 5K, respectively.

Chargers 75Y, 75M, 75C, and 75K, the developing devices 76Y, 76M, 76C, and 76K, the cleaners 77Y, 77M, 77C, and 77K, and dischargers are arranged around the photoconductive drums 5Y, 5M, 5C, and 5K, respectively.

Image forming processes including a charging process, an exposure process, a development process, a transfer process, and a cleaning process are performed on the photoconductor drums 5Y, 5M, 5C, and 5K to form yellow, magenta, cyan, and black toner images on the photoconductive drums 5Y, 5M, 5C, and 5K, respectively.

The photoconductor drums 5Y, 5M, 5C, and 5K are rotated clockwise in FIG. 3 by a driving motor(s). In the charging process, surfaces of the photoconductor drums 5Y, 5M, 5C, and 5K are uniformly charged with the chargers 75Y, 75M, 75C, and 75K, respectively.

In the exposure process, the charged surfaces of the photoconductor drums 5Y, 5M, 5C, and 5K arrive at irradiation positions of laser beams emitted from an exposure device 3. The exposure device 3 scans and exposes the charged surfaces of the photoconductive drums 5Y, 5M, 5C, and 5K at the irradiation positions to form electrostatic latent images corresponding to yellow, magenta, cyan, and black colors, respectively, on the surfaces of the photoconductor drums 5Y, 5M, 5C, and 5K.

In the development process, the surfaces of the photoconductive drums 5Y, 5M, 5C, and 5K arrive at development positions at which the photoconductive drums 5Y, 5M, 5C, and 5K oppose the developing devices 76Y, 76M, 76C, and 76K, respectively. At the development positions, the developing devices 76Y, 76M, 76C, and 76K render the electrostatic latent images formed on the surfaces of the photoconductive drums 5Y, 5M, 5C, and 5K visible to form yellow, magenta, cyan, and black toner images.

In a primary transfer process, the surfaces of the photoconductor drums 5Y, 5M, 5C, and 5K arrive at first transfer positions at which the photoconductive drums 5Y, 5M, 5C, and 5K oppose first transfer bias rollers 79Y, 79M, 79C, and 79K, respectively, via the intermediate transfer belt 78. At the first transfer positions, the yellow, magenta, cyan, and black toner images on the photoconductive drums 5Y, 5M, 5C, and 5K are transferred onto the intermediate transfer belt 78.

At this time, a slight amount of non-transferred toner remains on the photoconductor drums 5Y, 5M, 5C, and 5K.

In the cleaning process, the surfaces of the photoconductor drums 5Y, 5M, 5C, and 5K arrive at cleaning positions at which the photoconductor drums 5Y, 5M, 5C, and 5K oppose the cleaners 77Y, 77M, 77C, and 77K, respectively. At the cleaning positions, non-transferred toner particles remaining on the photoconductor drums 5Y, 5M, 5C, and 5K are mechanically collected by cleaning blades of the cleaners 77Y, 77M, 77C, and 77K.

Finally, the surfaces of the photoconductor drums 5Y, 5M, 5C, and 5K arrive at discharging positions at which the photoconductor drums 5Y, 5M, 5C, and 5K oppose the dischargers. At the discharging positions, the dischargers remove residual potential on the photoconductive drums 5Y, 5M, 5C, and 5K. Thus, a series of image forming processes performed on the photoconductive drums 5Y, 5M, 5C, and 5K is finished.

Then, yellow, magenta, cyan, and black toner images formed on the photoconductor drums 5Y, 5M, 5C, and 5K through the development process are transferred onto the intermediate transfer belt 78 so as to be superimposed one on another. As a result, a color toner image is formed on the intermediate transfer belt 78.

Here, the intermediate transfer unit 85 includes, e.g., the intermediate transfer belt 78, the first transfer bias rollers 79Y, 79M, 79C, and 79K, a second transfer backup roller 82, a cleaning backup roller 83, a tension roller 84, and an intermediate transfer cleaner 80.

The intermediate transfer belt 78 is supported by and stretched over three rollers, which are the second transfer backup roller 82, the cleaning backup roller 83, and the tension roller 84. Rotation of a single roller, that is, the second transfer backup roller 82 causes the intermediate transfer belt 78 to endlessly move in a direction indicated by an arrow R1. The four first transfer bias rollers 79Y, 79M, 79C, and 79K and the photoconductor drums 5Y, 5M, 5C, and 5K sandwich the intermediate transfer belt 78 to form first transfer nips, respectively.

The first transfer bias rollers 79Y, 79M, 79C, and 79K are applied with a transfer bias having a polarity opposite to a polarity of toner. The intermediate transfer belt 78 moves in the direction R1 to pass, in turn, the first transfer nips formed between the photoconductor drums 5Y, 5M, 5C, and 5K and the first transfer bias rollers 79Y, 79M, 79C, and 79K.

Thus, the yellow, magenta, cyan, and black toner images on the photoconductor drums 5Y, 5M, 5C, and 5K are primarily transferred and superimposed one on another on the intermediate transfer belt 78. The intermediate transfer belt 78 having the different color toner images superimposed moves to a second transfer position at which the intermediate transfer belt 78 opposes a second transfer roller 89.

At the second transfer position, the second transfer backup roller 82 sandwiches the intermediate transfer belt 78 between the second transfer roller 89 and the second transfer backup roller 82 to form a second transfer nip. The four-color toner images formed on the intermediate transfer belt 78 are transferred onto a recording medium P transported to the secondary transfer nip.

At this time, non-transferred toner, which has not been transferred onto the recording medium P, remains on the intermediate transfer belt 78. Then, the intermediate transfer belt 78 moves to a cleaning position of the intermediate transfer cleaner 80. At the cleaning position, non-transferred toner on the intermediate transfer belt 78 is collected.

Thus, a series of transfer processes performed on the intermediate transfer belt 78 are finished. A feed unit 12 is provided in a lower portion of the apparatus body 1 of the image forming apparatus 1000, and loads a plurality of recording media P. Recording media P are fed sheet by sheet from the feed unit 12 and transported to the secondary transfer nip via, e.g., a feed roller 97 and paired registration rollers 98.

For example, transfer sheets or other sheets of media serving as the recording media P are stacked in the sheet feed unit 12. When the feed roller 97 is rotated counterclockwise in FIG. 3, an uppermost one of the plurality of recording media P is fed toward a roller nip formed between the paired registration rollers 98.

The uppermost recording medium P fed by the feed roller 97 temporarily stops at the roller nip between the paired registration rollers 98, which stop rotating temporarily. The paired registration rollers 98 are rotated to feed the recording medium P to the second transfer nip so that the color toner images on the intermediate transfer belt 78 are transferred onto the recording medium P.

As a result, a desired color toner image is formed on the recording medium P. Then, the recording medium P having the color toner image is transported to a fixing device 20.

In the fixing device 20, a fixing belt 21 and a pressing roller 31 apply heat and pressure to the recording medium P to fix the color toner image on the recording medium P. Thereafter, the fixing device 20 feeds the recording medium P bearing the fixed color toner image to a nip between paired output rollers 99. The paired output rollers 99 output the recording medium P to an outside of the apparatus body 1.

The recording medium P output to the outside of the apparatus body 1 by the paired output rollers 99 is stacked on a stack portion 100 as an output image. Thus, a series of image forming processes in the image forming apparatus 1000 are finished.

Next, a configuration and operations of the fixing device 20 of the image forming apparatus 1000 are described below.

Figure 4:
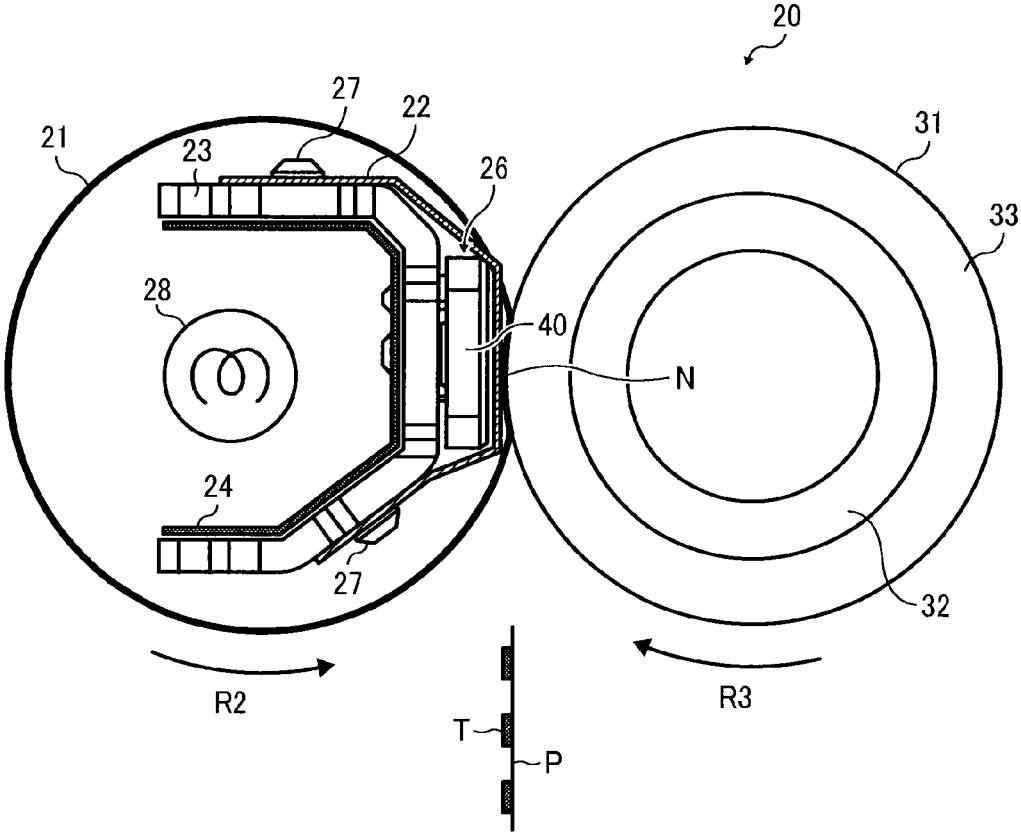
FIG. 4 is a cross sectional view of a fixing device according to an exemplary embodiment of this disclosure.

FIG. 4 is a schematic cross sectional view of a fixing device 20 according to an exemplary embodiment of this disclosure.

The fixing device 20 according to this exemplary embodiment includes a rotatable fixing member (fixing belt 21), a heat source (heater 28), a pressing member (pressing roller 31), a nip formation member (nip formation member 26), a reinforcement member (reinforcement member 23), a sliding sheet (sliding sheet 22), and holding members (holding members 27). The fixing member (fixing belt 21) has an endless shape. The heat source (heater 28) heats the fixing member. The pressing member (pressing roller 31) is disposed at an outer circumferential side of the fixing member so as to be able to press against the fixing member. The nip formation member (nip formation member 26) is disposed at an inner circumferential side so as to be pressed by the pressing member via the fixing member to form a nipping portion (nipping portion N). The reinforcement member (reinforcement member 23) is fixed in an internal diameter area of the fixing member to support the nip formation member from a first side of the nip formation member opposite a second side of the nip formation member at which the nip formation member forms the nipping portion N. The sliding sheet (sliding sheet 22) is disposed between the nip formation member and the inner circumferential surface of the fixing member. The holding members (holding members 27) are disposed on a member differing from the nip formation member to hold the sliding sheet in a state in which the sliding sheet is in close contact with a nipping face of the nip formation member that faces the nipping portion N.

As illustrated in FIG. 4, the fixing device 20 includes, e.g., the fixing belt 21, which is an endless belt-shaped member, the nip formation member (base member) 26, the reinforcement member (pressing stay) 23, the heater (heat source) 28, and the pressing roller 31 serving as a rotary pressing member.

The fixing belt 21 is a thin, flexible, and endless belt and rotates (runs) in a counterclockwise direction indicated by an arrow R2 in FIG. 4. For the fixing belt 21, a base layer, an elastic layer, and a release layer are laminated in turn from the inner circumferential surface side. The fixing belt 21 has a total thickness, e.g., not greater than 1 mm. The base layer of the fixing belt 21 has a thickness in, e.g., a range from 30 μm to 100 μm and includes a metal material, such as nickel and/or stainless steel, and/or a resin material such as polyimide.

The elastic layer of the fixing belt 21 has a thickness in, e.g., a range from 100 μm to 300 μm, and includes a rubber material such as silicon rubber, silicon rubber foam, and/or fluorocarbon rubber. The elastic layer prevents formation of minute surface asperities of the fixing belt 21 at the nipping portion N. As a result, heat is uniformly transmitted from the fixing belt 21 to a toner image T on a recording medium P, thus preventing formation of a rough surface image.

The release layer of the fixing belt 21 has a thickness in a range from 10 μm, to 50 μm, and includes, e.g., tetrafluoroethylene-perfluoroalkylvinylether copolymer (PFA), polytetrafluoroethylene (PTFE), polyimide, polyetherimide, and/or polyether sulfide (PES). The release layer securely releases or separates the toner image T from the fixing belt 21. The fixing belt 21 has a diameter in, e.g., a range from 15 mm to 120 mm.

As illustrated in FIG. 4, the pressing roller 31 serves as a rotary pressing member to contact and press against the outer circumferential surface of the fixing belt 21 at the nipping portion N. The pressing roller 31 has a loop diameter in a range from about 30 mm to about 40 mm. The pressing roller 31 has a hollow core metal 32 and an elastic layer 33 mounted around the core metal 32.

The elastic layer 31 includes, e.g., silicon rubber foam, silicon rubber, and/or fluorocarbon rubber. In some embodiments, a thin release layer including PFA or PTFE is provided as a surface layer on the elastic layer 33.

The pressing roller 31 has a gear to engage a driving gear of a driving mechanism and is rotated in a (clockwise) direction indicated by an arrow R3 in FIG. 4. Both ends of the pressing roller 31 in a width direction of the pressing roller 31, that is, in an axial direction of the pressing roller 31, are rotatably supported by side plates of the fixing device 20 via bearings. In some embodiments, a heat source, such as a halogen heater, is disposed inside the pressing roller 31.

The pressing roller 31 is pressed against the fixing belt 21 by a contact-and-separation mechanism to form a desired nip width at the nipping portion N. In some embodiments, the pressing roller 31 is a solid roller. In some embodiments, the pressing roller 31 is hollow, which is advantageous in reducing heat capacity.

When the elastic layer 33 of the pressing roller 31 includes a sponge material, such as silicon rubber foam, the pressing force of the pressing roller 31 applied to the nipping portion N can be reduced, thus suppressing bending of the nip formation member 26. In addition, since the pressing roller 31 can have an enhanced heat insulation, heat transmission from the fixing belt 21 to the pressing roller 31 is suppressed, thus enhancing the efficiency in heating the fixing belt 21.

The nip formation member 26 supported by the reinforcement member 23 is disposed inside a loop of the fixing belt 21. Receiving a driving force from the pressing roller 31 at the nipping portion N, the fixing belt 21 rotates. Meanwhile, since the heater 28, the reinforcement member 23, and the nip formation member 26 inside the loop of the fixing belt 21 are fixed, the fixing belt 21 slides while contacting the nip formation member 26.

The sliding sheet 22 formed of a porous sheet of PTFE resin is disposed between the inner circumferential surface of the fixing belt 21 and the nip-side face of the nip formation member 26 facing the nipping portion N. The fixing belt 21 slides over the nip formation member 26 via the sliding sheet 22. The sliding sheet 22 allows a reduction in sliding load, thus enhancing durability.

The nip formation member 26 includes polyphenylene sulfide (PPS), polyamide-imide (PAI), polyimide (PI), liquid crystal polymer (LCP), and/or other heatproof resin material. Opposed ends of the nip formation member 26 in the width direction are fixed on and supported by side plates of the fixing device 20. In FIG. 4, the nip formation member 26 forming the nipping portion N is planar in cross section. In some embodiments, the nip formation member 26 is concave in cross section or gradually changes from a planer shape to a concave shape in cross section.

In a case in which the nip formation member 26 is planar in cross section and the shape of the nipping portion N is substantially parallel to a surface of the recording medium P in which an image is recorded. such a configuration prevents wrinkling of the recording medium P. Alternatively, as the nip formation member 26 becomes concave in cross shape, the fixing belt 21 can more closely contacts the recording medium P, thus enhancing the fixing performance. Since the curvature of the fixing belt 21 increases at an exit side of the nipping portion N, the recording medium P sent from the nipping portion N can be easily separated from the fixing belt 21.

The reinforcement member 23 reinforces and supports the nip formation member 26 and is fixed at an inner circumferential surface side of the fixing belt 21. A length of the reinforcement member 23 in a width direction of the reinforcement member 23 is equivalent to a length of the stationary member 26 in a width direction of the stationary member 26. Both ends of the reinforcement member 23 in the width direction of the reinforcement member 23 are fixed on and supported by the side plates of the fixing device 20.

The reinforcement member 23 is pressed by the pressing roller 31 via the nip formation member 26 and the fixing belt 21. Such a configuration prevents the nip formation member 26 from being greatly deformed when the nip formation member 26 receives pressure from the pressing roller 31 at the nipping portion N. In some embodiments, to achieve the above-described functions, the reinforcement member 23 includes a metal material(s) having great mechanical strength, such as stainless steel and/or ferro-alloy.

In some embodiments, when the heater 28 is a type of heat source, e.g., a halogen heater, using radiant heat for heating, a reflection member (reflector) 26 is disposed on all or a portion of an opposing face of the reinforcement member 23 opposing the heater 28. In some embodiments, an insulation member is disposed on all or a portion of the opposing face of the reinforcement member 23 opposing the heater 28. In some embodiments, the opposing face of the reinforcement member 23 is bright-annealed (BA) or mirror-ground. Radiant head radiated from the heater 28 to the reinforcement member 23 (heat for heating the reinforcement member 23) is insulated or reflected, and used to heat the fixing belt 21, thus further enhancing heating efficiency.

A temperature sensor, e.g., a thermistor, is disposed opposing the outer circumferential surface of the fixing belt 21 to detect a temperature of the outer circumferential surface of the fixing belt 21. Output of the heater 28 is controlled based on detection results of the surface temperature of the fixing belt 21. Such output control of the heater 28 allows the temperature (fixing temperature) of the fixing belt 21 to be set to a desired temperature. In FIG. 4, a halogen heater is illustrated as an example of the heater 28. However, it is to be noted that the type of heat source is not limited to such a halogen heater and the fixing device may have, e.g., an induction heating type of heat source, a resistant heat generator, or a carbon heater.

In FIG. 4, the loop diameter of the fixing belt 21 is equivalent to the loop diameter of the pressing roller 31. In some embodiments, the loop diameter of the fixing belt 21 is smaller than the loop diameter of the pressing roller 31. In such a case, a curvature of the fixing belt 21 is smaller than a curvature of the pressing roller 31 at the nipping portion N, and therefore a recording medium P is easily separated from the fixing belt 21 when the recording medium P is discharged from the nipping portion N.

The fixing device 20 has a moving mechanism to contact and detach the pressing roller 31 relative to the fixing belt 21. In a normal fixing process, the pressing roller 31 presses the fixing belt 21 to form a desired nipping portion N. When the normal fixing process is not performed (e.g., during a jam removal process or during standby), the pressing roller 31 is detached from the fixing belt 21 (or the pressure of the pressing roller 31 against the fixing belt 21 is reduced).

Next, operations of the fixing device in a normal fixing process 20 are described below. When the image forming apparatus 1000 is powered on, power is supplied to the heater 28, and the pressing roller 31 starts rotating in the rotation direction R3 in FIG. 4.

Friction between the pressing roller 31 and the fixing belt 21 causes the fixing belt 21 to rotate in the rotation direction R2 in FIG. 4. Thereafter, a recording medium P is sent from the feed unit 12 to the second transfer nip formed between the intermediate transfer belt 78 and the second transfer roller 89. At the second transfer nip, color toner images T are transferred from the intermediate transfer belt 82 onto the recording medium P.

The recording medium P bearing the color toner images T is guided by a guide plate and transported to the nipping portion N formed between the fixing belt 21 and the pressing roller 31, which are in contact with each other. The toner images T are fixed on the surface of the recording medium P by heat of the fixing belt 21 heated by the heater 28 and a pressing force created between the pressing roller 31 and the nip formation member 26 reinforced by the reinforcement member 23. The recording medium P is fed from the nipping portion N and transported to the paired output rollers 99. Such a configuration of the fixing device 20 can reduce the warm-up time.

In some embodiments, a heat conductive member (holding member) made of, e.g., a tubular metal body serving as a shape retaining member to hold the inner circumferential surface of the fixing belt 21 to retain the shape of the fixing belt 21 is disposed in the loop of the fixing belt 21. The heat conductive member is disposed at a position other than the nip formation member 26 in a rotation direction of the fixing belt 21.

The heat conductive member is, e.g., a tubular member having a wall thickness of, e.g., 0.2 mm. In some embodiments, the heat conductive member includes aluminum, iron, stainless steel, or other metal heat conductor (heat conductive metal). In some embodiments, the heat conductive member has a wall thickness of 0.2 mm or lower, thus allowing enhancement of heating efficiency of the fixing belt 21.

In some embodiments, a gap "A" (gap not including the nipping portion N) between the fixing belt 21 and the heat conductive member at room temperature is preferably greater than 0 mm and not greater than 1 mm ($0\ \text{mm} < A \leq 1\ \text{mm}$).

Such a configuration prevents accelerated wearing of the fixing belt 21 due to an increased sliding area between the heat conductive member and the fixing belt 21, and also prevents a reduction in heating efficiency of the fixing belt 21 due to an increased distance between the heat conductive member and the fixing belt 21.

Moreover, providing the heat conductive member near the fixing belt 21 allows the fixing belt 21 to be maintained in a substantially circular loop form, thus suppressing degradation of and damage to the fixing belt 21 due to deformation of the fixing belt 21.

In some embodiments, to reduce the sliding resistance between the heat conductive member and the fixing belt 21, the sliding face of the heat conductive member includes a material of low friction coefficient. In some embodiments, the inner circumferential surface of the fixing belt 21 has a surface layer including a material containing fluorine. In some embodiments, the cross-sectional shape of the heat conductive member is substantially round. In some embodiments, the cross-sectional shape of the heat conductive member is polygonal.

Opposed end portions of the heat conductive member in the width direction of the heat conductive member are fixed on and supported by side plates of the fixing device 20. The heat conductive member is heated by radiant head (radiant light) of the heater 28, such as a halogen heater or a carbon heater, and heats the fixing belt 21. In other words, the heat conductive member is directly heated by the heater 28 (heating means), and the fixing belt 21 is indirectly heated by the heater 28 via the heat conductive member.

Next, a method of holding and fixing the sliding sheet 22 is described below.

As described above, the fixing belt 21 slidingly contacts the nip formation member 26 at the nipping portion N. To reduce the sliding load, the sliding sheet 22 serving as a highly-slidable sheet member is interposed between the nip formation member 26 and the inner circumferential surface of the fixing belt 21.

The sliding sheet 22 is constantly held between the nip formation member 26 and the fixing belt 21. When the sliding sheet 22 is installed, as described above, the sliding sheet 22 is wound around a surface of the nip formation member 26. and edge portions of the sliding sheet 22 are overlaid one on another and fixed with screws on a face of the nip formation member 26 opposite the nipping portion N.

The nip formation member 26 is pressed by the pressing roller 31 so as to press against the reinforcement member 23. The position of the nip formation member 26 directly affects the width or pressure of the nipping portion N. The thickness of the sliding sheet 22 is likely to vary with a pressed state of the sliding sheet 22. As a result, pressing the nip formation member 26 against the reinforcement member 23 via the sliding sheet 22 might increase variations in the shape of the nipping portion N.

To cope with such a challenge, the face of the nip formation member 26 opposite the nipping portion N has a plurality of protrusions (protruding shapes). The protrusions have such shapes that, when the sliding sheet 22 is wound around the nip formation member 26, the protrusions expose. Without intervention of the sliding sheet 22, such exposed protrusions contact the reinforcement member 23, thus allowing maintenance of the positional accuracy of the nipping portion N.

However, such a configuration of the nip formation member 26 might be disadvantageous in the following points.

First, screw holes for fastening the sliding sheet 22 wound around the nip formation member 26 are formed at the face of the nip formation member 26 opposite the nipping portion N. Here, for example, the nip formation member 26 includes thermal resistant material, such as LCP or PPS, as described above. Typically, the processing of forming screw holes in the nip formation member 26 is secondary processing, thus resulting in increased cost. For example, it is conceivable to mold screw holes in model molding (first processing). However, such molding is likely to be highly difficult, thus resulting in an increased cost. Since the nip formation member 26 is a member that directly affects the shape of the nipping portion P, a molding method using foreign objects, e.g., insertion screws is not employed.

In any of the processing methods, screw holes are formed in the nip formation member 26 for fastening. However, such a configuration may not easily obtain the strength of screw holes because the nip formation member 26 is made of, e.g., resin material. As a result, screw holes may be damaged during fastening of screws, thus resulting in a reduction in assembling performance.

As described above, multiple projections are provided at the face of the nip formation member 26 opposite the nipping portion N so as to contact the reinforcement member 23 when the pressing roller 31 is pressed toward the nip formation member 26. Since screw holes are provided at the face of the nip formation member 26 opposite the nipping portion N, the respective projections are not molded as an integral part of the nip formation member 26.

Here, to maintain the shape of the nipping portion N uniform, a line connecting tops of the projections has an R-shape to cancel (absorb) an amount in which the reinforcement member 23 is bent by receiving pressure from the pressing roller 31.

As a result, the heights of the projections are slightly different from each other, and the heights of the projections at opposed ends are different from each other. As described above, such a complex shape of the projections may be achieved with a high level of processing accuracy, a high difficulty level of production technology, and a relatively long time for component test after completion, thus making cost reduction difficult.

Additionally, to bring the projections at the face of the nip formation member 26 opposite the nipping portion N into contact with the reinforcement member 23, the projections are placed higher than heads of the screws for fixing the sliding sheet 22.

As a result, the total thickness of the nip formation member 26 is increased by at least the heights of the protrusions. Here, If the diameter of the fixing belt 21 is determined in advance, the reinforcement member 23 is disposed inside the loop of the fixing belt 21 at the cost of the height of the reinforcement member 23 in a direction in which the pressing force is applied to the reinforcement member 23. Since the height of the reinforcement member 23 in the direction in which the pressing force is applied to the reinforcement member 23 is a dimension most contributing the strength, a greater height of the reinforcement member 23 in the direction of the pressing force can enhance the stability of the shape of the nipping portion N over variations in the pressing force.

As for the above-described points, for the fixing device 20 according to this exemplary embodiment, the sliding sheet 22 is held by the holding members 27 in a state in which the sliding sheet 22 is in close contact with the nip formation member 26. The holding members 27 are disposed at a different member from the nip formation member 26. In other words, the holding members 27 of the sliding sheet 22 are separated from the nip formation member 26.

For this exemplary embodiment, as illustrated in FIG. 4, the holding members 27 are disposed at both sides of the reinforcement member 23 upstream and downstream from the nipping portion N in the rotation direction of the fixing belt 21. For example, the holding members 27 are fastening members (screws) fastened into screw holes provided In the reinforcement member 23. The holding members 27 are not limited to be provided at the reinforcement member 23. For example, in some embodiments, dedicated holding members are provided at a different member other than the nip formation member 26 fixed to the side plates of the fixing device 20 A holding method of the holding members 27 is not limited to the screw holes and the fastening members (screws) and may be any other method in which the sliding sheet 22 can be fixed.

Such a configuration obviates formation of the screw holes for fixing the sliding sheet 22 at the face of the nip formation member 26 opposite the nipping portion N, thus preventing the above-described challenges in processing and facilitating molding of the nip formation member 26. As a result, the above-described configuration can reduce the processing cost and prevent, e.g., damages to screw holes. Thus, the yield of product can be enhanced, thus reducing production cost.

As illustrated in FIG. 4, the nip formation member 26 is disposed in a wrapped space between the reinforcement member 23 and the sliding sheet 22 fixed to the reinforcement member 23. Such a configuration allows the sliding sheet 22 to be constantly interposed between the nip formation member 26 and the fixing belt 21. Such a configuration also allows the sliding sheet 22 and the nip formation member 26 to be held in close contact with each other during any of the forward rotation (in the direction R2 in FIG. 4) and the reverse rotation of the fixing belt 21.

Additionally, since the sliding sheet 22 does not closely contact the face of the nip formation member 26 opposite the nipping portion N, the above-described configuration obviates the screw holes and an area (sheet fixing area) for the screw holes. The nip formation member 26 directly contact and is pressed against the reinforcement member 23 without interposing the sliding sheet 22 between the nip formation member 26 and the reinforcement member 23, thus enhancing the positional accuracy of the nip formation member 26.

Figure 5:
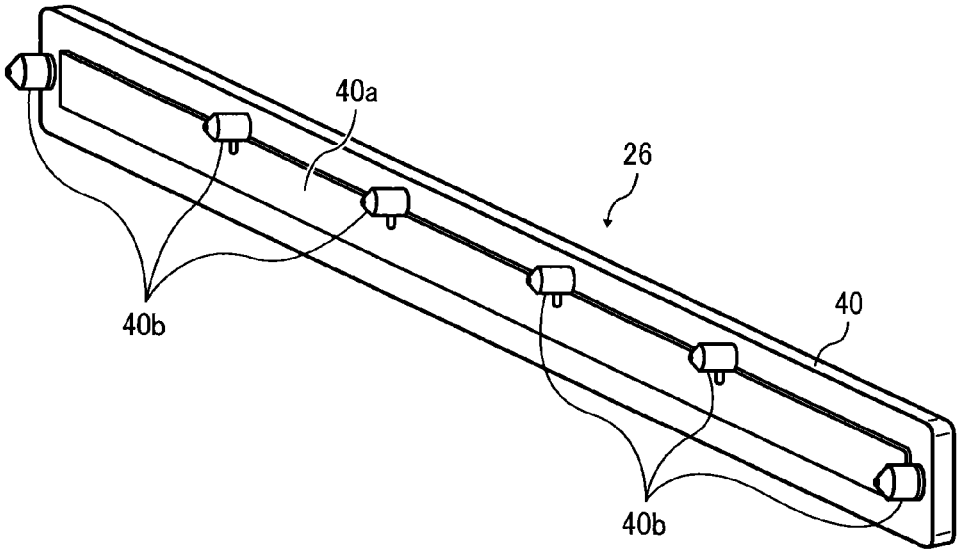
FIG. 5 is a perspective view of a nip formation member seen from a face of the nip formation member opposite a nipping portion.

FIG. 5 is a perspective view of the nip formation member 26 according to this exemplary embodiment, seen from the face of the nip formation member 26 opposite the nipping portion N.

This exemplary embodiment obviates formation of screw holes in the nip formation member 26. Hence, as illustrated in FIG. 5, for a base member 40 of the nip formation member 26, protruding portions 40*b* are integrated with a contact portion 40*a* serving as a connecting portion so as to be able to be integrally molded as a single member. Thus, an R shape is obtained as an undivided, seamless protruding member. Such a configuration facilitates the molding of the nip formation member 26, thus reducing production cost.

When the nip formation member 26 is pressed by the pressing roller 31, the seamless protruding member is brought into contact with the reinforcement member 23. Such a configuration cancels an amount at which the reinforcement member 23 is bent by the pressing force of the pressing roller 31, and prevents occurrence of non-pressed portions, thus allowing the nipping portion N to have a uniform width in the axial direction and a uniform pressure.

This exemplary embodiment also obviates screws for fixing the sliding sheet 22 to the nip formation member 26. Such a configuration reduces the height of the protruding portions 40*b* without considering the relationship with the heights of the protruding portions 40*b*, thus allowing a reduction in the total thickness of the nip formation member 26.

As a result, to enhance the strength of the reinforcement member 23, such a reduced amount can be used to increase the height of the reinforcement member 23 in the direction of the pressing force, thus suppressing variations in the width and pressure of the nipping portion N against variations in the pressing force.

For the above-described fixing device 20, the sliding sheet 22 is held by the holding members 27 separately provided from the nip formation member 26, and fixed to the nip formation member 26. Such a configuration can obviate a structure for fixing the sliding sheet 22 from the nip formation member 26. As a result, the configuration of the nip formation member 26 is simplified, thus reducing production cost.

The sliding sheet 22 is held by and fixed on the reinforcement member 23, and the nip formation member 26 is disposed in a space formed between the reinforcement member 23 and the sliding sheet 22. Such a configuration facilitates assembling and allows the sliding sheet 22 to be uniformly disposed over a whole nipping face of the nip formation member 26 facing the nipping portion N. Such a configuration also allows firm holding and fixing of the sliding sheet 22.

The face of the nip formation member 26 opposite the nipping portion N is not wound with the sliding sheet 22, and the nip formation member 26 directly contacts the reinforcement member 23. Such a configuration suppresses an increase in size and enhances the positional accuracy of the nipping portion N.

The fixing device 20 having the above-described configuration is used in, for example, the image forming apparatus illustrated in FIG. 3. Such a configuration provides an image forming apparatus having a fixing device that is easily assembled, is produced at relatively low cost, and forms a uniform nipping portion with less variations.

Next, a fixing device according to an exemplary embodiment of this disclosure is described below with reference to FIGS. 6 to 8.

Figure 6:
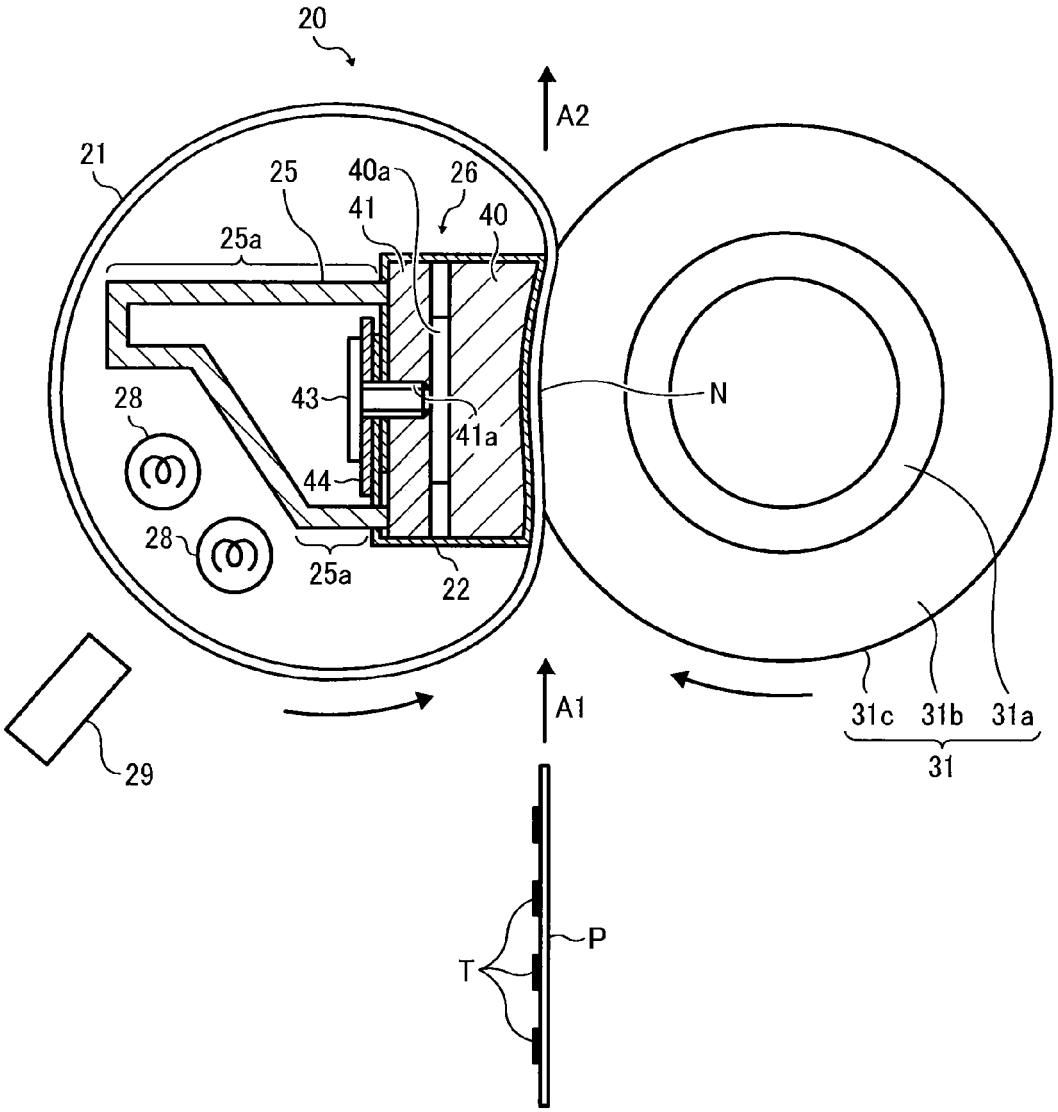
FIG. 6 is a schematic configuration view of a fixing device mountable in the image forming apparatus according to an exemplary embodiment of this disclosure.

FIG. 6 is a cross sectional view of a fixing device according to at least one exemplary embodiment of this disclosure. Below, a fixing device 20 is described with reference to FIG. 6.

As illustrated in FIG. 6, the fixing device 20 includes, for example, a fixing belt 21 serving as a fixing member, a pressing roller 31 serving as an opposed member to contact an outer circumferential surface of the fixing belt 21, a heater 28 serving as a heating source to heat the fixing belt 21, a nip formation member 26 to contact the pressing roller 31 from an inner circumferential side of the fixing belt 21 to form a nipping portion N, a stay 25 serving as a support member to support the nip formation member 26, and a temperature sensor 29 serving as a temperature detector to detect the temperature of the fixing belt 21.

In this exemplary embodiment, the fixing belt 21 is a thin, flexible, endless belt member (or a thin, flexible, endless film). Specifically, the fixing belt 21 includes a base at the inner circumferential side and a release layer at the outer circumferential side. The base includes a metal material, such as nickel or stainless steel (SUS), or a resin material, such as polyimide (PI). The release layer includes, e.g., tetrafluoroethylene-perfluoroalkylvinylether copolymer (PFA) or polytetrafluoroethylene (PTFE). In some embodiments, an elastic layer including a rubber material, such as silicone rubber, silicone rubber foam, and/or fluorocarbon rubber, is interposed between the base and surface release layer.

If such an elastic layer is not provided, the heat capacity of a fixing belt is reduced, thus enhancing the fixing performance. However, when unfixed toner is pressed against and fixed on the fixing belt, minute irregularities on a surface of the fixing belt are transferred to an image, uneven gloss might arise in a solid area of the image. To prevent such a failure, for example, an elastic layer having a thickness of 100 μm or greater is provided at the fixing belt. For the elastic layer having a thickness of 100 μm or greater, minute irregularities can be absorbed by elastic deformation of the elastic layer, thus preventing occurrence of uneven gloss.

For this exemplary embodiment, the fixing belt 21 is relatively thin and has a relatively small diameter to achieve a relatively low heat capacity of the fixing belt 21. For example, the base, the elastic layer, and the release layer forming the fixing belt 21 have thicknesses in ranges of 20 to 50 μm, 100 to 300 μm, and 10 to 50 μm, respectively, and a total thickness of the fixing belt 21 is 1 mm or smaller. The fixing belt 21 has a diameter of 20 to 40 mm. To achieve a relatively low heat capacity, in some embodiments, the total thickness of the fixing belt 21 is 0.2 mm or lower, or in some embodiments, the total thickness of the fixing belt 21 is 0.16 mm or lower. In some embodiments, the fixing belt 21 is 30 mm or lower.

The pressing roller 31 includes a core metal 31*a*, an elastic layer 31*b*, and a release layer 31*c*. The elastic layer 31*b* including, e.g., a silicone rubber foam, a silicone rubber, or a fluorocarbon rubber is disposed on a surface of the core metal 31*a*. The release layer 31*c* including, e.g., PFA or PTFE is formed on a surface of the elastic layer 31*b*. The pressing roller 31 is pressed toward the fixing belt 21 by a pressing unit so as to contact the nip formation member 26 via the fixing belt 21. In an area in which the pressing roller 31 is pressed against the fixing belt 21, the elastic layer 31*b* of the pressure roller 31 is compressed to form a predetermined width of the nipping portion N. The contact of the fixing member with the opposed member is not limited to the configuration in which the fixing member contacts the opposed member with pressure. In some embodiments, the fixing member simply contacts the opposed member with the fixing member not pressed against the opposed member.

The pressing roller 31 is rotated by a driving source, e.g., a motor provided in a body of the image forming apparatus. When the pressing roller 31 is rotated, the driving force is transmitted to the fixing belt 21 at the nipping portion N to rotate the fixing belt 21. Flange members are inserted to opposed end portions of the fixing belt 21 to rotatably hold the fixing belt 21.

For this exemplary embodiment, the pressing roller 31 is a solid roller. In some embodiments, the pressing roller 31 is a hollow roller. In such a case, a heating source, e.g., a halogen heater is disposed inside the pressing roller 31, In some embodiments, the elastic layer 31*b* includes solid rubber. In some other embodiments, a heat source is not provided inside the pressing roller 31 and the elastic layer 31*b* includes sponge rubber. Sponge rubber is advantageous in enhancing heat insulation and suppressing heat dissipation of the fixing belt 21.

The heater 28 is disposed at the inner circumferential side of the fixing belt 21. In this exemplary embodiment, in FIG. 6, two heaters 28 are disposed. In some embodiments, the number of the heater 28 is one, or not less than three. In FIG. 6, the heaters 28 are illustrated as halogen heaters. However, in some embodiments, as the heating source to heat the fixing belt 21, an induction heating (IH) coil(s), a resistant heat generator(s), or a carbon heater(s) is (are) used instead of a halogen heater.

The output of the heater 28 is controlled by a power unit to generate heat, and the power unit is disposed in the body of the image forming apparatus. The output control of the heater 28 by the power unit Is performed based on detection results of the surface temperature of the fixing belt 21 obtained from a temperature sensor 29. The output control of the heater 28 allows the temperature (fixing temperature) of the fixing belt 21 to be set to a desired temperature. In some embodiments, a temperature sensor to detect the temperature of the pressing roller 31 is disposed instead of the temperature sensor to detect the temperature of the fixing belt 21, and the temperature of the fixing belt 21 is estimated based on the temperature detected by the temperature sensor.

By receiving the pressing force of the pressing roller 31, the nip formation member 26 contacts the inner circumferential surface of the fixing belt 21. As a result, the shape of the nipping portion N is determined. For this exemplary embodiment, the shape of the nipping portion N is recessed. In some embodiments, the shape of the nipping portion N is flat or other shape. When the shape of the nipping portion N is recessed, the direction in which a front end of a recording medium P is discharged is closer to the pressing roller 31. As compared with the configuration in which the shape of the nipping portion N is flat, such a configuration facilitates separation of the recording medium P from the fixing belt 21, thus suppressing occurrence of sheet jam.

The stay 25 is disposed at the inner circumferential side of the fixing belt 21 and supports a back face of the nip formation member opposite the pressing roller 31. Such a configuration prevents the nip formation member 26 from being bent by pressure of the pressing roller 31, thus providing a uniform width of the nipping portion N in an axial direction of the pressing roller 31. To prevent bending of the nip formation member 26, in some embodiments, the stay 25 includes metal material, such as stainless steel or iron, having a high degree of mechanical strength. The stay 25 is fixed to and supported by paired side plates of the fixing device 20.

For this exemplary embodiment, the stay 25 has a pair of upright portions 25*a* extending in the pressing direction of the pressing roller 31 from end portions (an upper end portion and a lower end portion in FIG. 6) of the nip formation member 26 upstream and downstream in a feed direction of recording medium. For such a configuration, the stay 25 has a cross section extending in the pressing direction of the pressing roller 31 so as to be relatively long from side to side, and has a relatively large section modulus, thus enhancing the mechanical strength of the stay 25. For this exemplary embodiment, the upright portions 25*a* contact the end portions of the nip formation member 26 in the feed direction of recording medium, thus allowing the nip formation member 26 to be firmly supported at the end portions. Such a configuration allows more effective prevention of bending of the nip formation member 26 than when the nip formation member 26 is supported at a central portion in the feed direction of recording medium.

Next, basic operation of the fixing device in this exemplary embodiment is described with reference to FIG. 6.

When the image forming apparatus is powered on, power is supplied to the heater 28 and the pressing roller 31 starts rotating clockwise (in a direction indicated by an arrow R3) in FIG. 6. By friction created between the pressing roller 31 and the fixing belt 21, the fixing belt 21 is rotated counterclockwise (in a direction indicated by an arrow R2) in FIG. 6.

A recording medium P bearing an unfixed toner image T is guided by a guide plate in a direction A1 and fed to enter the nipping portion N formed between the fixing belt 21 and the pressing roller 31 pressed against each other. The toner image T is fixed on a surface of the recording medium P by heat of the fixing belt 21 heated by the heater 28 and pressing force created between the fixing belt 21 and the pressing roller 31.

The recording medium P having the toner image T fixed thereon is discharged from the nipping portion N in a direction indicated by an arrow A2 in FIG. 6. At this time, the front end of the recording medium P contacts a front end of a separation member, and the recording medium P is separated from the fixing belt 21. The recording medium P separated from the fixing belt 21 is discharged by the paired output rollers 99 to an outside of the body of the image forming apparatus and stacked on the stack portion 100 (see FIG. 3) as described above.

Below, a configuration of the fixing device according to this exemplary embodiment is described.

As illustrated in FIG. 6, the nip formation member 26 includes, e.g., a base member 40, a metal body 41, and a sliding sheet 22.

The base member 40 is a longitudinal member extending long in a width direction perpendicular to the feed direction of recording medium, i.e., the axial direction of the fixing sleeve 21. The base member 40 is fixed to and supported by the stay 25 via the metal body 41. The base member 40 thus supported receives the pressing force of the pressing roller 31 to determine the shape of the nipping portion N.

The base member 40 is preferably a heatproof member having a heat resistance of, e.g., 200 degrees centigrade or greater. The heatproof member includes a heatproof resin, such as polyethersulfone (PES), polyphenylenesulfide (PPS), liquid crystal polymer (LCP), polyether nitrite (PEN), polyamide imide (PAI), or polyetheretherketone (PEEK).

The sliding sheet 22 is formed with a member having a lubricity or a low friction relative to a recording medium. The sliding sheet 22 is interposed between the base member 40 and the fixing belt 21. Such a configuration reduces sliding friction between the fixing belt 21 and the nip formation member 26 during rotation of the fixing belt 21. For this exemplary embodiment, the sliding sheet 22 is wound around the base member 40 and the metal body 41 so as to cover the base member 40 and the metal body 41.

The metal body 41 is a plate member and, like the base member 40, extends long in the width direction perpendicular to the feed direction of recording medium. The metal body 41 has screw holes 41*a* used in screwing the sliding sheet 22. Both end portions of the sliding sheet 22 in the feed direction of recording medium are fixed to the metal body 41 with screws 43 inserted into the screw holes 41*a*.

More specifically, the end portions of the sliding sheet 22 are overlaid one on another on a back face of the metal body 41 facing the stay 25. Further, with a retaining member 44 of, e.g., a thin plate shape overlaid on an overlaid area of the end portions, the screws 43 are inserted into the screw holes 41*a* from the stay 25 side to fasten the sliding sheet 22 to the metal body 41. Each of the retaining member 44 and the sliding sheet 22 has holes through which the screws 43 are inserted.

Figure 7:
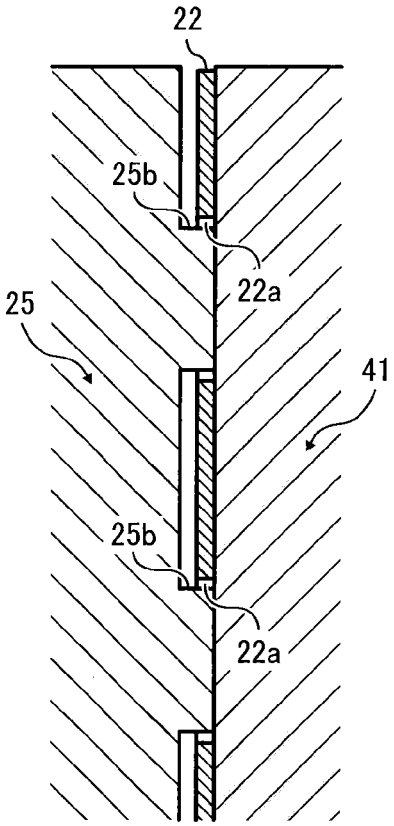
FIG. 7 is an enlarged cross sectional view of a contact area between a stay and a metal body, seen from an upper side of the fixing device of FIG. 6.

FIG. 7 is an enlarged cross sectional view of a contact area between the stay 25 and the metal body 41, seen from an upper side of the fixing device 20.

As illustrated in FIG. 7, the stay 25 has multiple projections 25*b* across the width direction. A portion of the sliding sheet 22 disposed on the back face side of the metal body 41 has through holes 22*a* at positions corresponding to the projections 25*b*. The projections 25*b* of the stay 25 are brought into direct contact with the back face of the metal body 41 through the through holes 22*a* of the sliding sheet 22.

The base member 40 in this exemplary embodiment has the same configuration of the base member 40 illustrated in FIG. 5. Therefore, the base member 40 in this exemplary embodiment is described below with reference to FIG. 5. As illustrated in FIG. 5, multiple protruding portions 40*b* are provided at the back face of the base member 40 to position the base member 40. The protruding portions 40*b* are insertable into the positioning holes of the metal body 41. When the protruding portions 40*b* are inserted into the corresponding positioning holes, the base member 40 is positioned relative to the metal body 41.

As illustrated in FIG. 5, a contact portion 40*a* serving as a connecting portion to directly contact the metal body 41 is provided across the width direction at the back face of the base member 40. A projecting face of the contact portion 40*a* is arranged in a convex curved shape so as to gradually protrude more toward the metal body 41 from each end to the center of the base member 40 in the width direction.

Figure 8:
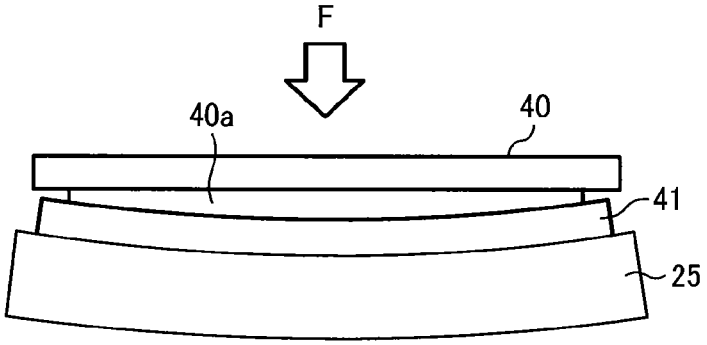
FIG. 8 is a schematic view of a state in which the stay is bent by a pressing force.

As illustrated in FIG. 8, when the base member 40 receives a pressing force F from the pressure roller 31 and contacts the metal body 41, the stay 25 is bent by the pressing force F because the stay 25 are supported at the end portions but not supported at the center portion. When the stay 25 is bent, the metal body 41 supported by the stay 25 is also bent. However, for the base member 40, as described above, the contact portion 40*a* has the convex curved shape in which the center portion most protrudes. The contact portion 40*a* of the base member 40 contacts the metal body 41, thus preventing bending of the base member 40. Such a configuration allows a nipping face of the base member 40 forming the nipping portion N to be maintained in a flat state, thus allowing the pressure distribution in the nipping portion N to be uniformly maintained across the width direction.

Below, a configuration of a fixing device according to a comparative example is described with reference to FIGS. 9 and 10.

Figure 9:
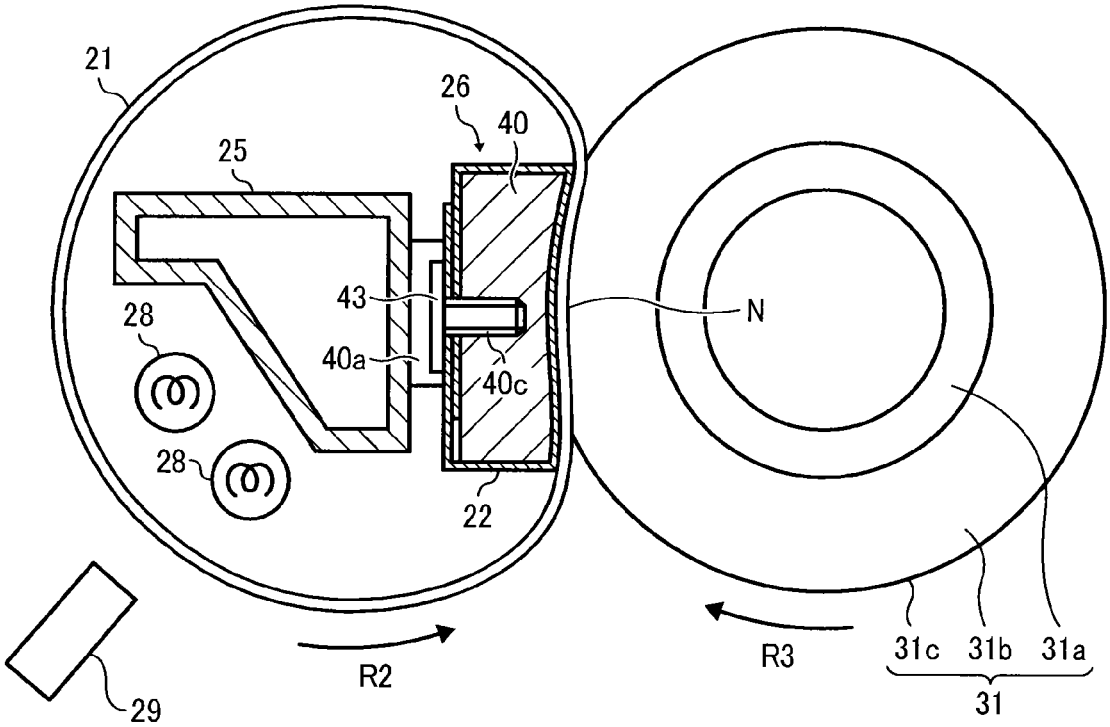
FIG. 9 is a schematic configuration view of a fixing device according to a comparative example.

Unlike the above-described exemplary embodiment of this disclosure, the fixing device according to a comparative example illustrated in FIG. 9 does not have the metal body 41. Hence, a base member 40 has screw holes 40*c*, and screws 43 are inserted into the screw holes 40*c* to screw both end portions of a sliding sheet 22 wound around the base member 40.

The base member 40 has contact portions 40*a* having protruding shapes to contact a stay 25. The contact portions 40*a* configured to penetrate through the sliding sheet 22 and protrude beyond the sliding sheet 22. Such a configuration allows the contact portions 40*a* to directly contact the stay 25 without interposing the sliding sheet 22 that is variable in thickness due to pressure. Thus, the positional accuracy of the base member 40 to determine the width or pressure of the nipping portion N is securely obtained.

Figure 10:
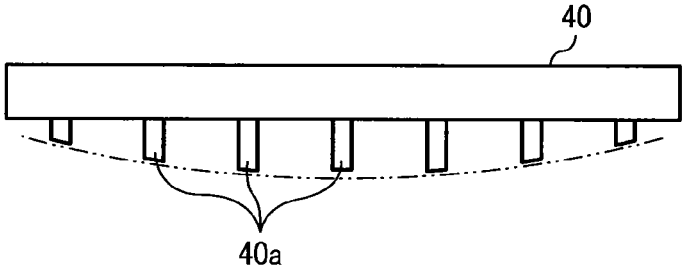
FIG. 10 is a schematic view of a configuration of a contact area of a base member in the comparative example of FIG. 10.

For the comparative example, as illustrated in FIG. 10, the contact portions 40*a* are separately provided on the base member 40 unlike the above-described exemplary embodiment. The contact portions 40*a* are arranged to gradually protrude more and more from each end to a center portion of the base member 40 in the width direction so that an imaginary line (indicated by a broken line in FIG. 10) connecting front edges of the contact portions 40*a* be a convex curved line. Such a configuration of the contact portions 40*a* can absorb influence of bending of the stay 25 over the base member 40, as in the above-described exemplary embodiment.

However, the comparative example may be disadvantageous in some points because of the configuration in which the sliding sheet 22 is fixed to the base member 40 with the screws. First, the screw holes 40*c* are formed in the base member 40 to fasten the sliding sheet 22 to the base member 40 with the screws. From viewpoints of heat resistance and productivity, typically, the base member 40 is a molded resin product including, e.g., liquid crystal polymer (LCP) or polyphenylene sulfide (PPS). However, tap processing for forming the screw holes 40*c* is secondary processing, thus resulting in an increased cost. Additionally, since the strength of the screw holes 40*c* is difficult to securely obtain, slots might be broken in assembling. It is conceivable to simultaneously mold the screw holes 40*c* in molding the base member 40. However, such a method is highly difficult, thus resulting in an increased production cost. Since the base member 40 is a member affecting the shape of the shape of the nipping portion N, it is not so preferable to adopt a molding method including foreign matter, such as insertion screws.

Second, to reliably bring the contact portions 40*a* into contact with the stay 25, the heights (protruding amounts) of the contact portions 40*a* are set to be higher than the heights of screw heads. As the heights of the contact portions 40*a* increase, the size of the base member 40 in the pressing direction of the pressure roller also increases. As a result, to place the base member 40, the stay 25, and other members in a limited space in a loop of the fixing belt 21, the stay 25 has a reduced size in the pressing direction, thus resulting in a reduced strength of the stay 25 against the pressing force of the pressure roller.

In a configuration in which the screws 43 are fastened to the base member 40, the contact portions 40*a* are disposed at positions other than the positions at which the screws 43 are fastened to the base member 40. As a result, the contact portions 40*a* are separately provided on the base member 40. Additionally, as described above, in the configuration in which the front ends of the contact portions 40*a* are arranged along the imaginary line of a convex curved shape, the contact portions 40*a* have different heights, and each of the contact portions 40*a* has different heights at both ends in the width direction, thus resulting in a relatively complicate configuration of the contact portions 40*a*. Additionally, the contact portions 40*a* are molded with high degree of precision. As a result, the degree of difficulty in production may increase and it may take a relatively long time for component tests after end of production, thus making cost reduction difficult.

Hence, for this exemplary embodiment of this disclosure, the sliding sheet 22 is fixed on the metal body 41, not the base member 40. Such a configuration obviates screw holes for screwing the sliding sheet 22 to the base member 40, thus facilitating molding of the base member 40. Such a configuration can also reduce processing cost of screw holes and production cost caused by an assembling error due to lack of the strength of screw holes. For the above-described exemplary embodiment, since the screw holes are formed at the metal body 41 having a high degree of stiffness, highly precise processing can be relatively easily performed while securely obtaining the strength of the screw holes, as compared with the case in which the screw holes are formed in the base member 40 made of a resin material.

Next, for the above-described exemplary embodiment of this disclosure, since the screws 43 are not fastened to the base member 40, the necessity of setting the height of the contact portion 40*a* to be higher than the screw heads can be obviated, thus reducing the height of the contact portion 40*a*. As a result, the size of the stay 25 in the pressing direction can be increased, thus enhancing the strength of the stay 25 against the pressing force of the pressure roller.

Additionally, for the configuration according to this exemplary embodiment, when the contact portion 40*a* is formed at the base member 40, it is not necessary to avoid the fastening positions of the screws, thus obviating the necessity for separately providing the contact portion 40*a* in divided positions. As a result, like the above-described exemplary embodiment, the contact portion 40*a* is continuously disposed across the base member 40 in the width direction. Thus, the configuration of the contact portion 40*a* is simplified and a highly precise molding of the contact portion 40*a* is facilitated, thus reducing the production cost.

Additionally, the configuration of the above-described exemplary embodiment is advantageous in, e.g., the following points. As illustrated in FIG. 6, for the above-described exemplary embodiment, the base member 40 directly contacts the metal body 41, and the metal body 41 directly contacts the stay 25. In other words, the sliding sheet 22 is not interposed each of contact portions between the base member 40 and the metal body 41 and between the metal body 41 and the stay 25, thus enhancing the positional accuracy of the base member 40. Such a configuration allows highly precise maintenance of, e.g., the width or pressure of the nipping portion N.

As illustrated in FIG. 7, at the contact portion at which the stay 25 and the metal body 41 directly contact each other, the through holes 22*a* are formed in the sliding sheet 22, thus allowing the projections 25*b* of the stay 25 to directly contact the metal body 41. Such a configuration allows the stay 25 and the metal body 41 to directly contact each other even in a state in which the sliding sheet 22 is wound around the base member 40 and the metal body 41.

By winding the sliding sheet 22 and overlaying the end portions of the sliding sheet 22 in the feed direction of recording medium, the end portions are fixed with the common screws 43, thus enhancing assembling performance. Additionally, since the end portions of the sliding sheet 22 in the feed direction of recording medium are fixed, such a configuration prevents the position of the sliding sheet 22 from being shifted by forward or reverse rotation of the fixing belt 21, thus allowing the sliding sheet 22 to be reliably held between the base member 40 and the fixing belt 21.

With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. For example, a fixing device to which exemplary embodiments of this disclosure and their variations are applicable are not limited to the configuration illustrated in FIG. 6. For example, in some embodiments, a fixing device may have a reflector to reflect heat from a heater 28 to a fixing belt 21 and a heat shield to shield heat of the heater 28 in accordance with the width of recording media. In some embodiments, a fixing device may have other components. Additionally, an image forming apparatus mounting a fixing device according to any of exemplary embodiments of this disclosure and their variations is not limited to the printer as illustrated in FIG. 3 and, for example, any other type of printer, a copier, a facsimile machine, or a multi-functional device having at least one of the foregoing capabilities.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device, comprising:

a rotary fixing member having an endless shape;

a heater to heat the rotary fixing member;

a pressing member disposed at an outer circumferential side of the rotary fixing member to press against the rotary fixing member;

a nip formation member disposed at an inner circumferential side of the rotary fixing member and configured to be pressed by the pressing member via the rotary fixing member to form a nipping portion;

a reinforcement member stationarily disposed in an internal diameter area of the rotary fixing member to directly support the nip formation member from a first side of the nip formation member opposite a second side of the nip formation member at which the nip formation member faces the nipping portion;

a sliding sheet disposed between the nip formation member and an inner circumferential face of the rotary fixing member; and a holding member disposed at a member differing from the nip formation member to hold the sliding sheet in a state in which the sliding sheet is in close contact with a nipping face of the nip formation member facing the nipping portion, wherein at least a part of the sliding sheet is disposed directly between the holding member and the reinforcement member, and a part of the reinforcement member that is disposed between the heater and the nipping portion is at least partially surrounded by the sliding sheet.

2. The fixing device of claim 1, wherein the holding member is disposed at each of first and second sides of the reinforcement member upstream and downstream, respectively, from the nipping portion in a rotation direction of the rotary fixing member.

3. The fixing device of claim 2, wherein the nip formation member is disposed in a space formed between the reinforcement member and the sliding sheet fixed on the reinforcement member.

4. The fixing device of claim 1, wherein the holding member is configured to hold the sliding sheet between the rotary fixing member and the nip formation member so that the sliding sheet and the nip formation member closely contacts each other regardless of a rotation direction of the rotary fixing member.

5. The fixing device of claim 1, wherein an opposite face of the nip formation member opposite the nipping face is configured to contact the reinforcement member without interposing the sliding sheet.

6. The fixing device of claim 1, wherein an opposite face of the nip formation member opposite the nipping face has multiple protruding portions and a contact portion, the protruding portions are configured to contact the reinforcement member, and the protruding portions are connected via the contact portion to form a single member.

7. An image forming apparatus comprising the fixing device of claim 1.

8. The fixing device of claim 1, wherein the holding member includes a plurality of fasteners, and one of the fasteners is in a position that is slanted relative to a position of another one of the fasteners.

9. A fixing device, comprising:

a fixing member having an endless shape;

a base member disposed at an inner circumferential side of the fixing member;

a sliding sheet via which the base member contacts an inner circumferential surface of the fixing member;

an opposed member configured to contact an outer circumferential surface of the fixing member at a position opposing the base member;

a support member directly supporting the base member; and a metal body via which the base member is fixed relative to the support member, the sliding sheet fixed on the metal body, wherein at least a part of the sliding sheet is disposed directly between the metal body and the support member, and the metal body is configured to directly contact the base member.

10. The fixing device of claim 9, wherein the metal body has screw holes to screw the sliding sheet on the metal body.

11. The fixing device of claim 9, wherein the base member is made of a resin material.

12. The fixing device of claim 9, wherein the metal body is configured to directly contact the support member.

13. The fixing device of claim 9, wherein protruding portions configured to contact the metal body and arranged in a width direction of the base member perpendicular to a feed direction of a recording medium, and a central one of the protruding portions in the width direction protrudes more toward the metal body than ones at both ends of the protruding portions in the width direction.

14. The fixing device of claim 9, wherein the sliding sheet has end portions fixed on a back face of the metal body facing the support member, the sliding sheet has through holes in an area in which the sliding sheet is disposed on the back face of the metal body, and the support member has projections to directly contact the back face of the metal body through the through holes.

15. The fixing device of claim 9, wherein both end portions of the sliding sheet in a feed direction of a recording medium are fixed on the metal body.

16. An image forming apparatus comprising the fixing device of claim 9.

* * * * *